United States Patent [19]

Daswick

[11] 4,345,387

[45] Aug. 24, 1982

[54] RESILIENT INNER SOLE FOR A SHOE

[76] Inventor: Alexander C. Daswick, 647 Orange Grove, South Pasadena, Calif. 91030

[21] Appl. No.: 135,333

[22] Filed: Mar. 31, 1980

[51] Int. Cl.[3] ..... A43B 13/38; A43B 7/06; A43B 13/20

[52] U.S. Cl. ..... 36/43; 36/3 B; 36/29

[58] Field of Search ..... 36/43, 44, 3 R, 3 B, 36/28, 29, 32 R

[56] References Cited

U.S. PATENT DOCUMENTS

| | | | |
|---|---|---|---|
| 1,167,885 | 1/1916 | Carll | 36/32 R |
| 1,194,152 | 8/1916 | Douglas | 36/3 B |
| 2,090,881 | 8/1937 | Wilson | 36/29 |
| 4,112,599 | 9/1978 | Krippelz | 36/44 X |
| 4,215,492 | 8/1980 | Sandmeier | 36/3 B |
| 4,223,456 | 9/1980 | Cohen | 36/29 |

FOREIGN PATENT DOCUMENTS

| | | | |
|---|---|---|---|
| 474016 | 3/1929 | Fed. Rep. of Germany | 36/3 B |
| 942294 | 5/1956 | Fed. Rep. of Germany | 36/43 |
| 604587 | 9/1978 | Switzerland | 36/44 |

*Primary Examiner*—James Kee Chi

*Attorney, Agent, or Firm*—Gene W. Arant

[57] ABSTRACT

A resilient inner sole for a shoe is integrally formed from resilient material into a generally flat sheet member. The sheet member has a flat under surface with a plurality of openings which are upwardly enlarged to form air pockets, and the resilient material of the member extends over and thereby encloses the upper sides of the air pockets. When an impact is received upon an upper surface of the member, the member compresses, and air flows from the air pockets outward through the associated openings.

7 Claims, 14 Drawing Figures

10
11
12
13
14
15
16
20
20a
21
22
23a
23b
23c
24a
24b
24c
25a
25b
25c
2
3
-11-

RESILIENT INNER SOLE FOR A SHOE

BACKGROUND OF THE INVENTION

The present invention relates to an inner sole for a shoe, which may be firmly attached inside a new shoe as initially manufactured so that it is a permanent part thereof, or which may be inserted into a shoe that has already been worn.

PRIOR ART

Pertinent prior art known to the applicant includes U.S. Pat. No. 4,075,772 issued to Sicurella, and entitled "INSOLE FOR FOOTWEAR".

DRAWING SUMMARY

FIRST EMBODIMENT

(FIGS. 1-4)

Reference is now made to FIGS. 1-4, inclusive, illustrating a first embodiment of the invention.

Figures 1, 4:
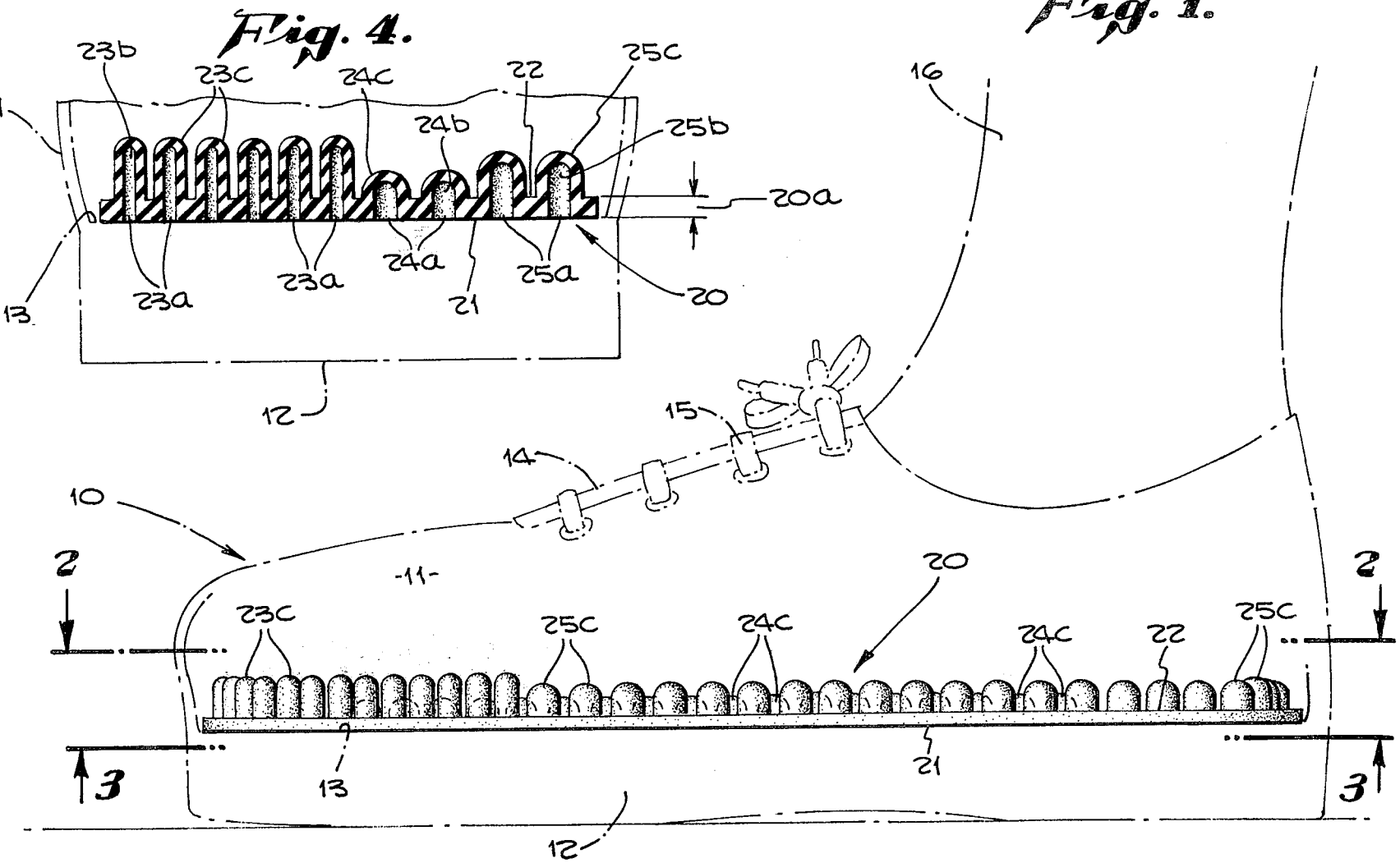
FIG. 1 is a side elevational view of a first embodiment of resilient inner sole in accordance with the invention, the inner sole being shown in solid lines and located inside a shoe that is shown in dashed line.
FIG. 4 is a cross-sectional elevational view of the inner sole of FIG. 1 taken on line 4—4 of FIG. 2.

As shown in FIG. 1, a shoe 10 includes a shoe upper structure 11 and a sole structure 12 which are shown only in dashed lines. The upper surface of the sole structure is designated as 13. The shoe upper 11 is closed by a tongue 14 which in turn is tied by a shoe string 15. The ankle 16 of a person wearing the shoe is also shown in dashed lines, but the foot of the wearer is not specifically shown.

A resilient inner sole 20 in accordance with the present invention is contained within the shoe 10 and rests upon the upper surface 13 of sole structure 12. Since the inner sole 20 is shown in all of FIGS. 1 through 4, reference is now made to all of those drawing figures for the purpose of describing the structure of the resilient inner sole 20.

Figure 2:
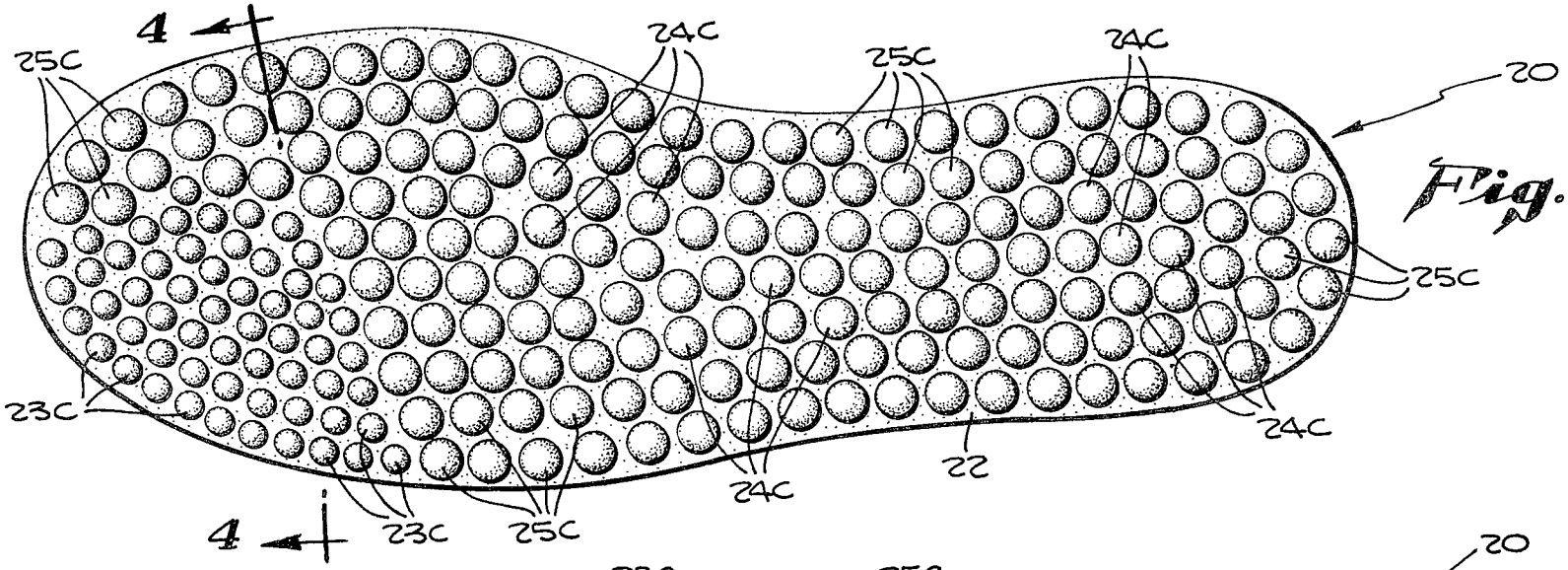
FIG. 2 is a top plan view of the inner sole of FIG. 1 taken on line 2—2 thereof.
Figure 3:
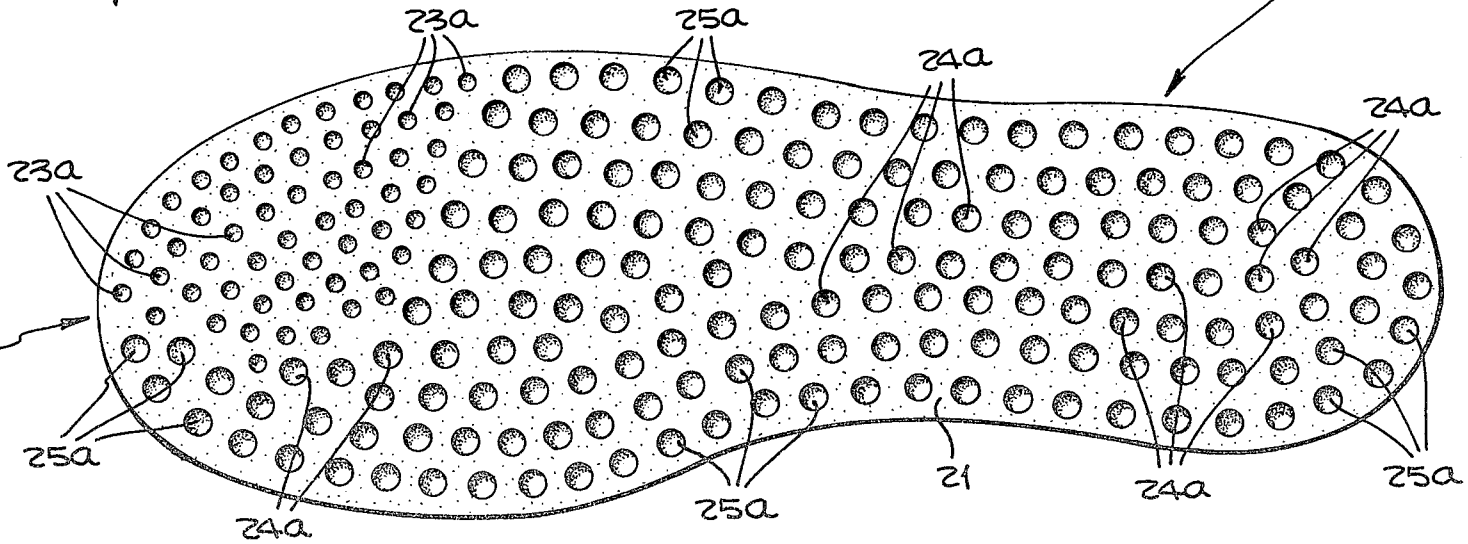
FIG. 3 is an underneath view of the inner sole of FIG. 1 taken on line 3—3 thereof.

The inner sole 20 is formed as a generally flat sheet member of a highly resilient material, such as a relatively soft rubber. As shown in FIGS. 2 and 3 this sheet member is cut into a contour such as to fit the well known configuration of the bottom of a shoe. Sheet member 20 has an under surface 21 and an upper surface 22, as most clearly seen in FIG. 4. Under surface 21 is absolutely flat but has a number of openings formed therein. These include openings 23*a*, 24*a*, 25*a*. Each of the openings extends upward to form a corresponding air pocket, the air pockets being designated as 23*b*, 24*b*, and 25*b*. Each of these air pockets in turn is closed at its upper end by a protrusion, with air pocket 23*b* being closed by a protrusion 23*c*, air pocket 24*b* being closed by a protrusion 24*c*, and air pocket 25*b* being closed by a protrusion 25*c*. Each protrusion has a smoothly rounded upper surface.

More specifically, the resilient inner sole 20 is molded or cast as an integral unit. The mold, not shown in the drawings, includes a flat bed or base portion from which a number of pins with rounded ends protrude upward. Each of the pins in the mold forms a corresponding hole or opening in the lower flat surface 21 of the inner sole and also forms the associated air pocket above that hole or opening. The rubber or other resilient material when cast in the mold flows over the upper ends of the pins and forms a continuous structure having no air passageways extending through it.

As shown in FIG. 4 the flat or base portion of the inner sole 20 is of uniform thickness, this thickness being designated by dimension lines 20*a* on the right hand side of FIG. 4. The wall surrounding each of the air pockets, and also forming the protrusion above the air pocket, is somewhat thinner than this flat or base portion of the inner sole.

Typical design values for the inner sole 20 shown in FIGS. 1-4 may be as follows. The thickness of the base 20*a* may be 1/10 of an inch. Protrusions 24*c* may rise above the base by another 1/10 inch for a total height of 2/10 inch. Protrusions 25*c* may rise above the base by 2/10 inch for a total height of 3/10 inch. And protrusions 23*c* may rise above the base by 3/10 inch for a total height of 4/10 inch. But these values are illustrative only. The total height of the inner sole in the vertical direction may be $\frac{1}{2}$ inch or more, or it may be $\frac{1}{4}$ inch or even less. Preferably the height of the highest protrusions will be such that the maximum thickness of the inner sole in the vertical direction will be between about $\frac{1}{4}$ inch and about $\frac{1}{2}$ inch.

In drawing FIGS. 1-4 it will be seen that protrusions 24*c* and protrusions 25*c* are of about the same diameter in the horizontal plane, while protrusions 23*c* are of lesser diameter. As best seen in FIG. 2 the taller protrusions 23*c* can be easily identified because of their smaller diameter. There are 57 of them in the illustrated embodiment. They extend from the region of the metatarsal arch all the way forward so as to lie under all of the small toes, but do not underlie the large toe of the wearer's foot. It will also be seen that the longest row of the protrusions 23*c* arranged along the outer periphery of the inner sole contains 13 such protrusions, while the seventh or inner row of these protrusions contains only three of them. As also shown in FIG. 2 there are two rows of medium height protrusions 25*c* which extend along the inner edge of the inner sole, along its outer edge, and also around its heel portion. The interior portion of the inner sole 20 extending along its transverse center is occupied by the short protrusions 24*c*.

In operation, the resilient and upwardly extending protrusions of the inner sole serve to support and cushion the under surface of the wearer's foot and will easily bend, depress, or telescope within themselves so as to conform to the shape of the wearer's foot. The adaptability of these resilient protrusions therefore serves to equalize the weight load imposed by the foot, and also to cushion the impact that is associated with walking, jogging, or running.

Although not readily apparent from the drawing FIGS. 1 through 4, the air that occupies the air pockets within the resilient inner sole is also of great functional importance. Specifically, depressing some of the protrusions causes the associated air pockets to contract, squeezing air downward so that it flows between the under surface 21 of the inner sole and upper surface 13 of the sole structure 12. To some extent this excess air flows into other air pockets of the inner sole, and to some extent it escapes at the side edges of the resilient inner sole and is lost. But it is also true that the soft rubber or other resilient material from which the inner sole 20 is made has a relatively high co-efficient of static friction, thereby tending to grip the upper surface 13 of sole structure 12 rather tightly and hence to prevent or at least restrict the lateral flow of air between the horizontal flat surfaces 13, 20. Therefore, to a considerable extent the air within each air pocket tends to remain entrapped within that pocket, and simply becomes compressed when the associated protrusion is depressed or squeezed. This compression of the air within the air pockets provides a spring action which aids the wearer of the shoe in achieving a rebound action each time that he lifts his foot off the ground.

Thus, in summary, the operation of the air within the air pockets is highly significant, because the air is able to flow laterally in order to equalize the vertical load imposed by the foot upon different portions of the inner sole 20 and hence upon the shoe sole structure 12. At the same time the entrapped air becomes compressed to some extent in response to each impact of the wearer's foot upon the ground, and then provides a spring or rebound action when the foot is to be lifted from the ground.

SECOND EMBODIMENT

(FIGS. 5-7)

Figure 5:
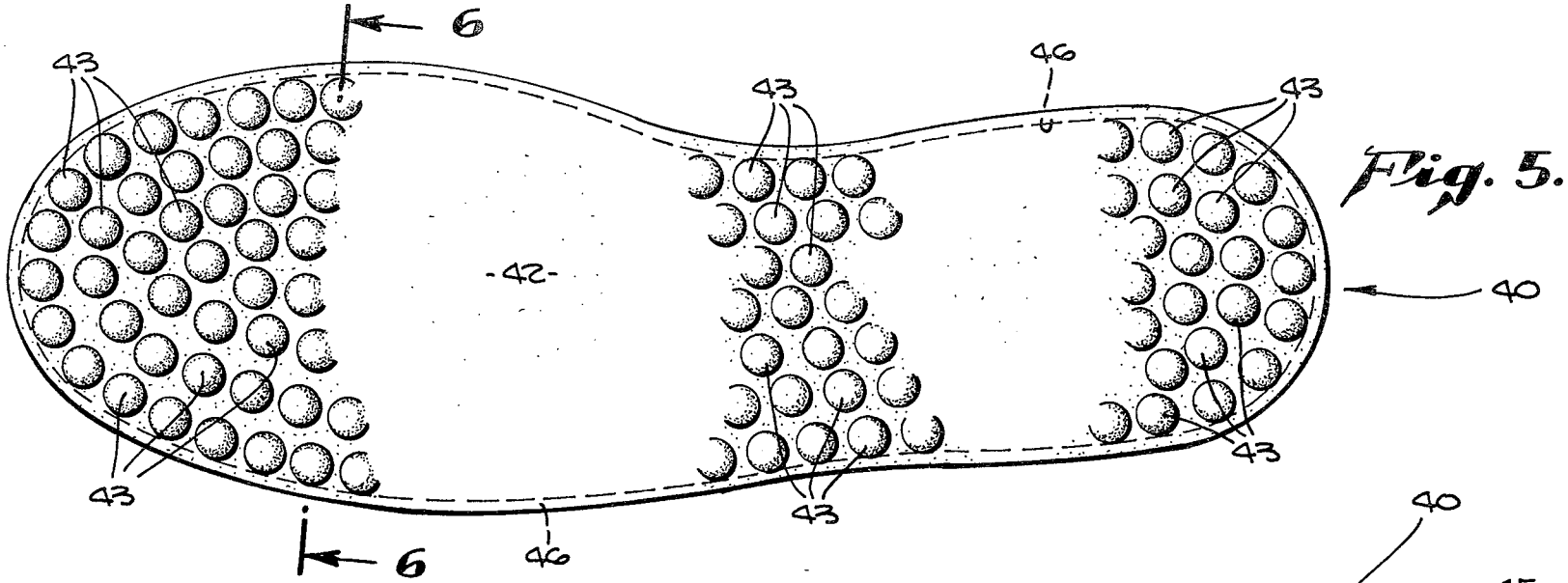
FIG. 5 is a top plan view of an inner sole for a shoe in accordance with a second embodiment of the invention.
Figure 7:
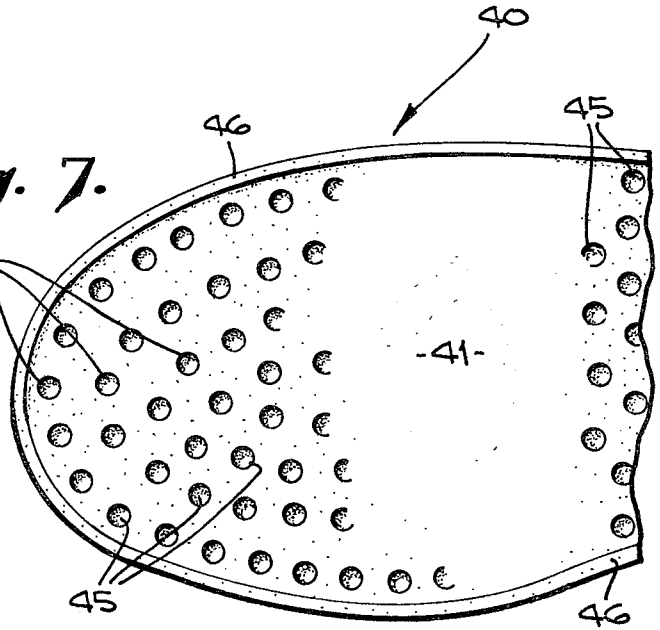
FIG. 7 is an underneath view of a portion of the inner sole of FIG. 4, taken on line 7—7 of FIG. 6.
Figure 6:
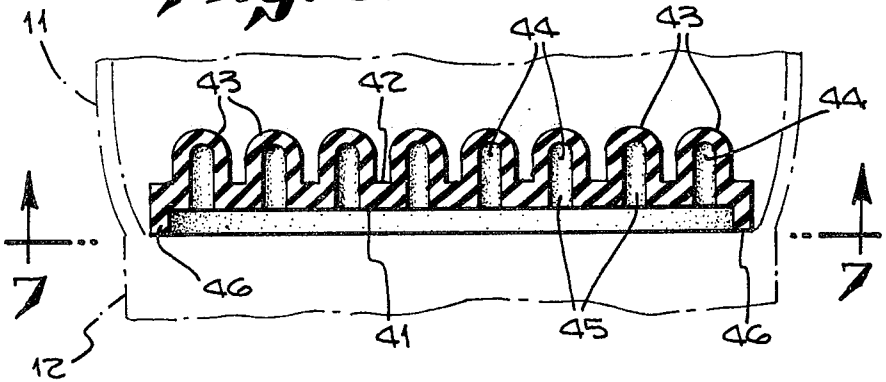
FIG. 6 is a cross-sectional elevational view of the inner sole of FIG. 5 taken on line 6—6 thereof.
Figure 8:
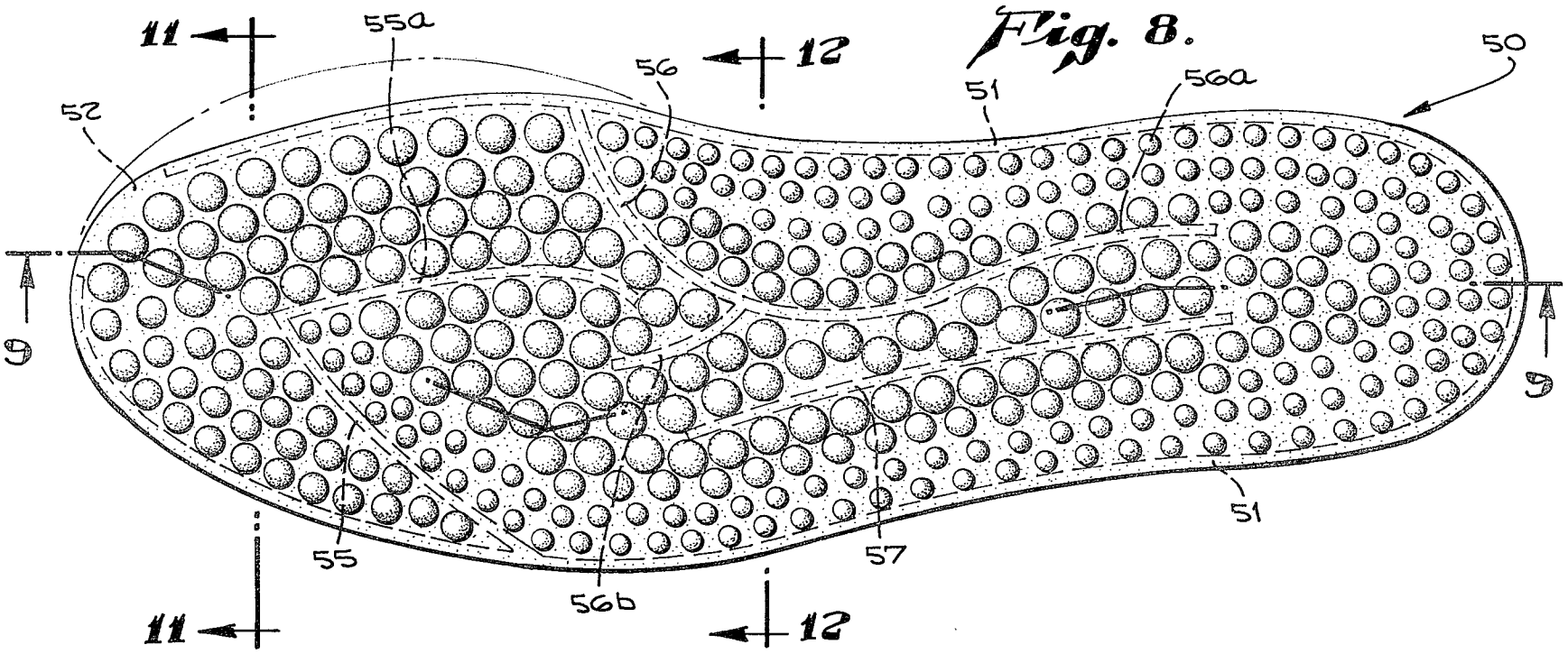
FIG. 8 is a top plan view of a resilient inner sole for a shoe in accordance with a third embodiment of the invention.
Figure 9:
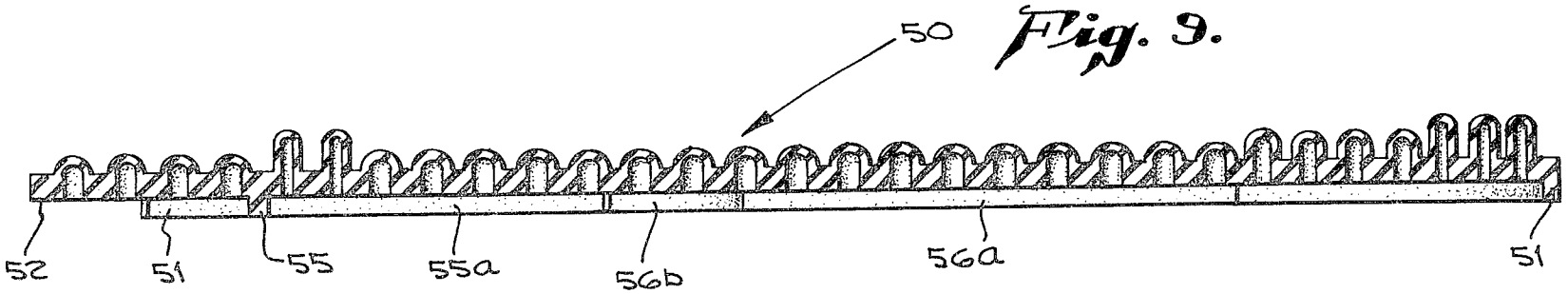
FIG. 9 is a longitudinal cross-sectional elevational view of the inner sole of FIG. 8 taken on line 9—9 thereof.

Reference is now made to FIGS. 5 through 7 of the drawings illustrating a second embodient of the invention.

Resilient inner sole 40, like the first embodiment, is cast or molded as a single integral piece. It has a flat under surface 41, FIG. 7. It has a flat upper surface 42 above which a large number of protrusions 43 extend, and the under surface has a number of openings 45 formed therein. Each of the protrusions 43 is of about the same size and configuration as the protrusions 25*c* of the first embodiment, and hence contains an air pocket 44 of substantially the same size as air pocket 25*b* of the first embodiment. In the second embodiment all of the upward protrusions 43 are of the same size and same shape.

A novel feature of the second embodiment is a peripheral flange 46 which extends downwardly from the outer edge of the under flat surface 41 of the resilient inner sole 40. Flange 46 is continuous and extends the full length of the inner edge of the inner sole, the full length of its outer edge, all the way around the toe portion, and all the way around the heel portion. The size of the flange 46 may, for example, be about 1/10 inch lateral thickness, and 1/10 inch high, or somewhat more or somewhat less, although its thickness and its height do not have to be equal to each other.

The primary function of the peripheral flange 46 is to prevent the escaspe of air along the lateral edges of the resilient inner sole. That is, when the wearer of the shoe moves his foot down into engagement with the ground, in either a walking or running movement, the air which is then squeezed out of the air pockets will tend to remain within the confines of the peripheral flange 46. Another function of the peripheral flange is that, by raising the peripheral edge of the inner sole above the upper surface 13 the shoe sole structure, it becomes easier for air to flow laterally underneath the inner sole between one air pocket and another, thereby more effectively equalizing the distribution of vertical load.

THIRD EMBODIMENT

(FIGS. 8-12)

Reference is now made to FIGS. 8 through 12, inclusive, illustrating a third embodiment of the invention.

Resilient inner sole 50, like the previous embodiments, is integrally molded or cast as a single piece. As in the two previous embodiments, substantially its entire expanse is filled with upward protrusions, each protrusion containing an air pocket which opens to the under side of the resilient sheet member. The upward protrusions are of three different heights, just as in the first embodiment, and the locations of the tall and short protrusions are generally similar to what has been described in conjunction with the first embodiment. Hence it seems unnecessary to describe the various protrusions and their associated air pockets in detail.

Figures 10, 11, 12, 13, 14:
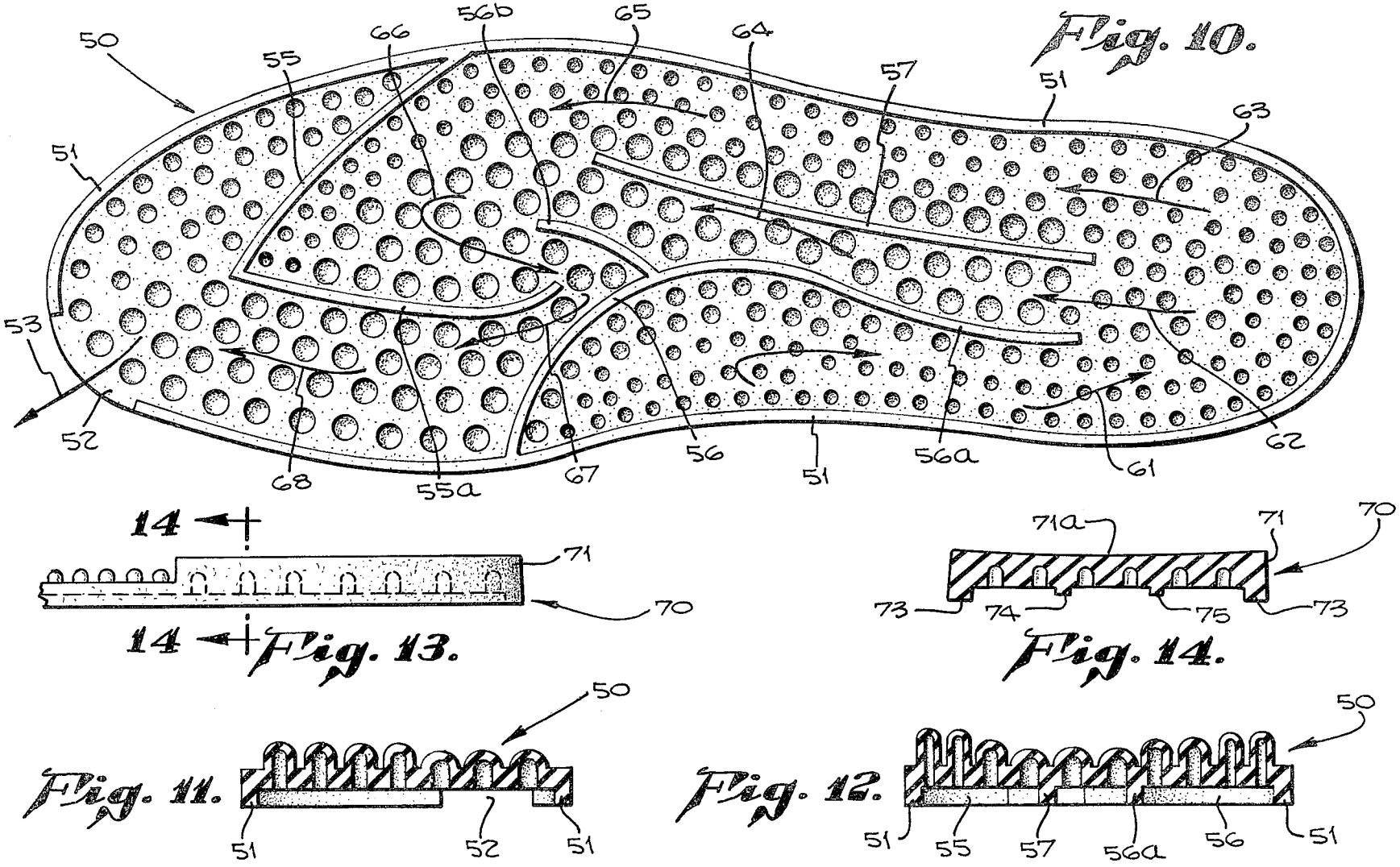
FIG. 10 is an underneath view of the inner sole of FIG. 8.
FIG. 11 is a transverse cross-sectional elevational view of the inner sole of FIG. 8 taken on line 11—11 thereof.
FIG. 12 is a transverse cross-sectional elevational view of the inner sole of FIG. 8 taken on line 12—12 thereof.
FIG. 13 is a side elevational view of the heel and adjacent portion of an inner sole in accordance with a fourth embodiment of the invention.
FIG. 14 is a transverse cross-sectional elevational view of the heel portion of the inner sole of FIG. 13, taken on line 14—14 of FIG. 13.

The resilient inner sole 50 also has a downwardly extending peripheral flange 51 on its underside, the full extent of which is best seen in FIG. 10. This peripheral flange 51 extends the full length of the inner edge of the resilient sole member 50, the full length of its outer edge, and all the way around the toe portion. More specifically, a gap 52 is left underneath the location of the big toe, in which the flange 51 is omitted, thereby permitting outward flow of air as indicated by the arrow 52 in FIG. 10.

The purpose of gap 52 is as follows. Whether the wearer of the shoe is walking or running, with the exception of sprint running, there will generally be a rolling action in which the heel of the shoe first contacts the ground and then the wearer of the shoe progressively shifts his weight forward towards the toe of the shoe. The purpose of peripheral flange 51 is to keep the entrapped air confined underneath the resilient sole member in order to provide a cushioning support. But before a take-off action with the toes is fully achieved it is desirable to permit the entrapped air to flow out of the gap 52 so that the toes are firmly supported by the shoe sole structure 12 and hence are able to provide a firm guidance action for imparting forward movement in a desired direction to the leg and hence also to the body of the wearer of the shoe.

The third embodiment of the invention also includes integrally formed interior flanges 55, 55*a*, 56, 56*a*, 56*b* and 57. These flanges are best seen in FIG. 10. Their purpose is to guide the air flow as it moves laterally underneath the resilient inner sole member. Thus the flange 55 is attached to flange 51 at the outer edge of the resilient inner sole and in the region of the metatarsal arch. It then extends both inwardly and forwardly, where its extension portion 55*a* then extends in a rearwardly direction substantially parallel to the inner edge of sole member 50. Flange 56 is connected to peripheral flange 51 on the inner edge of the sole member and generally opposite the innermost end of the flange 55*a*. It then extends rearwardly and inwardly in a direction generally parallel to flange 55, then curves and extends generally parallel to both the inner and outer edges of the resilient sole member. This last extension is the portion designated 56*a*. Flange 56*b* commences just rearwardly of the extremity of flange 55*a*, being attached to the flange 56 and extending outwardly therefrom but in a direction forwardly of the sole member. Flange 57 is not attached to the peripheral flange 51 at all but extends generally parallel to it, and also generally parallel to both of the flange extensions 56*a*, 56*b*.

It will be noted from FIG. 10 that flanges 55, 56, and 57 do not fully entrap the air beneath a particular region of the resilient inner sole member, but instead serve to guide and direct the flow of air from one piece to another. Specifically, when the heel of the wearer strikes with vertical impact upon the ground, flanges 56 and 56*a* preclude air entrapped under the high arch portion of the wearer's foot from flowing either forward or laterally to the side. It must instead remain entrapped or else flow rearwardly under the heel portion of the foot as shown by arrow 61. Air that is squeezed from air pockets underneath the heel of the foot may flow forward in the lateral center of the foot being guided between the flanges 56*a*, 56*b* on one side and flange 57 on the other side. The air squeezed from the air pockets underneath the heel may also flow forward under the outer edge of the foot, being guided between flanges 57 and 51. These flows are indicated by arrows 62 and 63, respectively, as well as by arrows 64 and 65, respectively. When this entrapped air reaches the region beneath the metatarsal arch portion of the foot it must then flow laterally toward the inner edge of the foot, then slightly rearwardly, as indicated by arrow 66 in FIG. 10. This movement is required by the cooperative action of the flanges 55*a*, 55*b*. The air then flows forwardly as indicated by arrow 67 and 68 until it reaches the escape gap 52.

In between ground contacts it is necessary for the air pockets to become refilled and the protrusions of the inner sole to resume their normal shape. This occurs naturally, since the lifting of the wearer's foot relieves pressure on the inner sole.

FOURTH EMBODIMENT

(FIGS. 13–14)

Reference is now made to FIGS. 13 and 14 illustrating a fourth embodiment of the invention.

As in the prior embodiments, the resilient inner sole member 70 is molded or cast as an integral unit. Its central portion, shown in FIG. 13, and its forward portion, not specifically shown, are filled with upward protrusions having their upper ends rounded, as in the prior embodiments. At its heel end, however, the sole member 70 has a raised generally flat heel portion 71. The size and shape of this heel portion are more clearly seen in FIG. 14.

As specifically shown in FIG. 14, it is preferred that the upper surface 71*a* of heel 71 be formed with a significant concave curvature in a lateral direction. This curved surface then tends to snugly receive the heel portion of the wearer's foot and retain it in its proper position.

An advantage of the solid heel portion 71 is that it provides a greater quantity of resilient material for purpose of cushioning the impact of the heel. This is particularly important when running or jogging.

The vertical thickness of the solid heel portion 71 is preferably about $\frac{3}{8}$ inch.

Another feature of the fourth embodiment is that the outer flange 73 on its lower surface has both greater thickness and greater height than the interior flanges 74, 75. When the wearer's heel impacts upon the ground, this arrangement tends to cause the upper concave surface 71*a* to bend and become even more concave. Furthermore, the fact that the outer flange 73 is both higher and thicker than the interior flanges, provides better assurance that the entrapped air will remain underneath the resilient sole member rather than escaping laterally outward at its edges.

ALTERNATE FORMS

The four illustrated embodiments of the invention have distinctive features which may be used together in various combinations. For example, distinctive features of the first embodiment may be combined with distinctive features of any of the other embodiments. Similarly, distinctive features of each embodiment may be used in conjunction with any of the other embodiments.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An inner sole for a shoe, comprising:

a generally flat sheet member made of resilient material;

said sheet member having a flat under surface with a plurality of openings therein which are upwardly enlarged to form air pockets, the material of said member extending across and thereby enclosing the upper sides of said air pockets;

whereby air flows through said openings out of or into the associated air pockets in response to impacts upon the upper surface of said member;

said sheet member also having a peripheral flange depending downwardly from the outer portion of the under surface thereof, said flange extending around most of the perimeter of said member; and a gap in said flange so that air may flow into or out of the space between the under surface of said member and the supporting surface of a shoe within which said inner sole is placed.

2. An inner sole as claimed in claim 1 wherein said sheet member forms upwardly extending protrusions above at least some of said air pockets, the upper surfaces of said protrusions being smoothly rounded.

3. An inner sole as claimed in claim 2 wherein the heel portion of said sheet member has a thickness of about $\frac{3}{8}$ inch and has a generally flat upper surface.

4. An inner sole as claimed in claim 1 wherein said sheet member also has a pair of downwardly depending flanges on the under surface thereof which are located interiorly of said peripheral flange.

5. An inner sole as claimed in claim 4 wherein the vertical height of said peripheral flange is greater than the vertical height of said interior flanges.

6. An inner sole as in claim 1 wherein said gap is underneath the toe portion of said member.

7. An inner sole as claimed in claim 6 wherein said sheet member also has a pair of downwardly depending flanges on the under surface thereof which are located interiorly of said peripheral flange.

* * * * *